US010981745B2

(12) United States Patent
Kotani et al.

(10) Patent No.: US 10,981,745 B2
(45) Date of Patent: Apr. 20, 2021

(54) SHEET POST-PROCESSING DEVICE AND IMAGE FORMING SYSTEM PROVIDED THEREWITH

(71) Applicant: KYOCERA Document Solutions Inc., Osaka (JP)

(72) Inventors: Takashi Kotani, Osaka (JP); Kazuhisa Iwamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/945,422

(22) Filed: Jul. 31, 2020

(65) Prior Publication Data

US 2021/0039911 A1 Feb. 11, 2021

(30) Foreign Application Priority Data

Aug. 5, 2019 (JP) ..... JP2019-143595

(51) Int. Cl.
*B65H 37/04* (2006.01)
*B65H 31/30* (2006.01)

(52) U.S. Cl.
CPC ..... *B65H 31/3081* (2013.01); *B65H 31/3027* (2013.01); *B65H 37/04* (2013.01); *B65H 2404/73* (2013.01); *B65H 2511/30* (2013.01)

(58) Field of Classification Search
CPC ..... B65H 31/3027; B65H 31/3081; B65H 2404/73; B65H 2511/30
USPC ..... 270/58.13, 58.28
See application file for complete search history.

(56) References Cited

U.S. PATENT DOCUMENTS

| | | | | |
|---|---|---|---|---|
| 6,241,234 | B1 * | 6/2001 | Saitoh | B65H 31/3027 270/58.12 |
| 7,192,020 | B2 * | 3/2007 | Hayashi | B42C 1/12 270/58.01 |
| 7,284,752 | B2 * | 10/2007 | Nagata | B65H 37/00 270/58.08 |
| 7,798,481 | B2 * | 9/2010 | Terao | B65H 31/3018 270/58.13 |
| 2006/0145408 | A1 | 7/2006 | Kotani | 270/58.08 |
| 2009/0166946 | A1 | 7/2009 | Iguchi et al. | 270/58.08 |
| 2019/0071273 | A1 * | 3/2019 | Dobashi | B65H 31/3081 |

FOREIGN PATENT DOCUMENTS

| | | |
|---|---|---|
| JP | 2006-188325 A | 7/2006 |
| JP | 2009-155110 A | 7/2009 |

* cited by examiner

*Primary Examiner* — Leslie A Nicholson, III
(74) *Attorney, Agent, or Firm* — Stein IP, LLC

(57) ABSTRACT

A sheet post-processing device includes a processing tray, a post-processing mechanism, a discharge roller pair, a bundle discharge member, a loading tray, a sheet holding member, a discharge drive portion, a tray lifting-lowering drive portion, a sheet holding drive portion, and a control portion. In a case where a number A of sheets included in a sheet bundle loaded on the processing tray is smaller than a predetermined number A1, the control portion discharges the sheet bundle onto the loading tray by using the discharge roller pair, with the loading tray arranged at a reference position. In a case where the number A of the sheets included in the sheet bundle is equal to or larger than the predetermined number A1, the control portion discharges the sheet bundle onto the loading tray by using the bundle discharge member, with the loading tray having been lifted above the reference position.

6 Claims, 12 Drawing Sheets

SHEET POST-PROCESSING DEVICE AND IMAGE FORMING SYSTEM PROVIDED THEREWITH

INCORPORATION BY REFERENCE

This application is based upon and claims the benefit of priority from the corresponding Japanese Patent Application No. 2019-143595 filed on Aug. 5, 2019, the entire contents of which are incorporated herein by reference.

BACKGROUND

The present disclosure relates to a sheet post-processing device which performs predetermined post-processing on a sheet such as a paper sheet having an image formed thereon by an image forming apparatus such as a copier, a facsimile machine, a printer, or the like, and an image forming system provided therewith.

Sheet post-processing devices have conventionally been used which are capable of stacking a plurality of sheets (paper sheets) on which images have been formed by an image forming apparatus such as a copier, a printer, or the like, and performing post-processing such as stapling processing of binding the stacked sheets as a sheet bundle with a staple, punching processing of forming a hole (punched hole) using a punching device, etc.

Such sheet post-processing devices each include a discharge roller pair which discharges a post-processed sheet and a loading tray on which the sheet discharged by the discharge roller pair is loaded. A post-processed sheet or sheet bundle is discharged by the discharge roller pair onto the loading tray.

A known example of such sheet post-processing devices is provided with a lifting-lowering mechanism which lifts and lowers a main sheet discharge tray, and a control portion which controls the lifting-lowering operation performed by the lifting-lowering mechanism, the control portion performing control to make the lifting-lowering mechanism lift and lower the main sheet discharge tray in synchronization with discharging of a sheet onto the main sheet discharge tray. According to this configuration, even when a sheet having been discharged from the apparatus main body is curled up or down, it is possible to prevent a negative effect of such curling on discharging of subsequent sheets.

As means for discharging a sheet bundle onto a loading tray, a configuration is known which uses a sheet bundle discharge member instead of a discharge roller pair. Specifically, there is known a sheet post-processing device having a bundle claw belt and a bundle claw (a bundle discharge member) for discharging a stapled sheet bundle from a processing tray.

SUMMARY

According to an aspect of the present disclosure, a sheet post-processing device includes a processing tray, a post-processing mechanism, a discharge roller pair, a bundle discharge member, a loading tray, a sheet holding member, a discharge drive portion, a tray lifting-lowering drive portion, a sheet holding drive portion, and a control portion. The processing tray receives a predetermined number of sheets to have the sheets loaded thereon. The post-processing mechanism performs predetermined post-processing with respect to a sheet bundle loaded on the processing tray. The discharge roller pair includes a drive roller and a driven roller which follows the drive roller to rotate, and discharges the sheet bundle loaded on the processing tray. The bundle discharge member is reciprocatable along a loading surface of the processing tray, and discharges the sheet bundle loaded on the processing tray by pushing out the sheet bundle. The loading tray is arranged on a downstream side of the processing tray with respect to a discharge direction of the sheet bundle, and on the loading tray, the sheet bundle having been discharged by the discharge roller pair or by the bundle discharge member is loaded. The sheet holding member is arranged below the discharge roller pair, and is swingable between a holding position at which the sheet holding member holds an upstream part, in the discharge direction, of the sheet bundle loaded on the loading tray and a retraction position at which the sheet holding member releases holding of the sheet bundle. The discharge drive portion drives the discharge roller pair and the bundle discharge member. The tray lifting-lowering drive portion lifts and lowers the loading tray. The sheet holding drive portion swings the sheet holding member to the holding position and to the retraction position. The control portion controls the tray lifting-lowering portion, the discharge drive portion, and the sheet holding drive portion. In a case where a number A of sheets included in the sheet bundle loaded on the processing tray is smaller than a predetermined number A1, the control portion discharges the sheet bundle onto the loading tray by using the discharge roller pair, with the loading tray arranged at a reference position. In a case where the number A of the sheets included in the sheet bundle is equal to or larger than the predetermined number A1, the control portion discharges the sheet bundle onto the loading tray by using the bundle discharge member, with the loading tray having been lifted above the reference position.

Still other objects of the present disclosure and specific advantages provided by the present disclosure will become further apparent from the following descriptions of embodiments.

DETAILED DESCRIPTION

Figure 1:
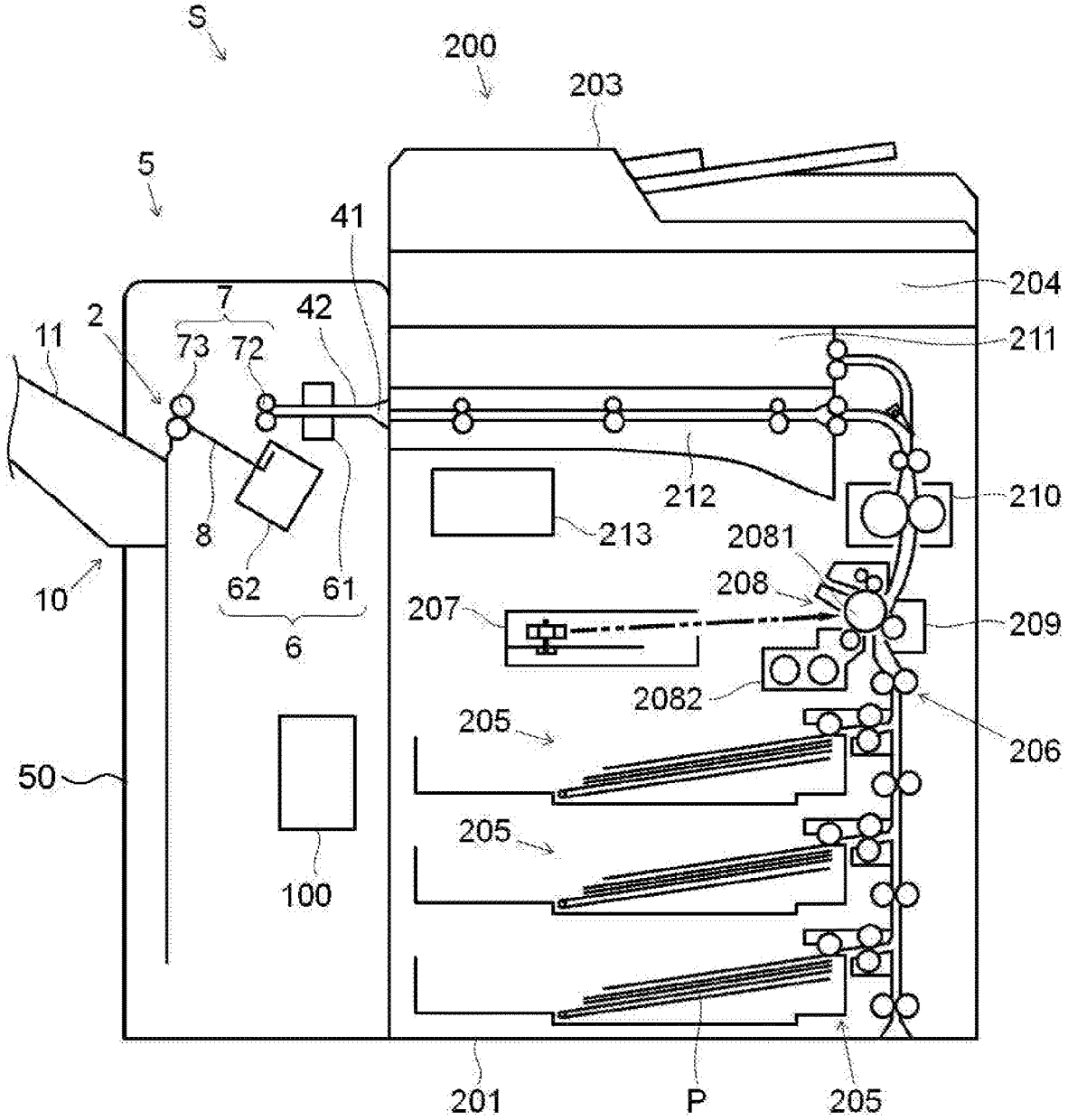
FIG. 1 is a schematic diagram of an image forming system including an image forming apparatus and a sheet post-processing device according to an embodiment of the present disclosure.

Hereinafter, an embodiment of the present disclosure will be described with reference to the accompanying drawings. FIG. 1 is a schematic diagram of an image forming system S which includes an image forming apparatus 200 and a sheet post-processing device 5 according to an embodiment of the present disclosure. The image forming system S includes the image forming apparatus 200 and the sheet post-processing device 5.

The image forming apparatus 200 is what is called a monochrome multifunction peripheral having functions of, for example, printing (print), scanning (image reading), and facsimile transmission. In the image forming apparatus 200, as shown in FIG. 1, a document transport portion 203 is placed on a top surface of a main body portion 201. At a position that is below the document transport portion 203 but is inside the main body portion 201, an image reading portion 204 is provided. The image reading portion 204 reads an image on a document loaded on the document transport portion 203 or an image on a document placed on an unillustrated contact glass provided on a top surface of the image reading portion 204.

The image forming apparatus 200 further includes a sheet feeding portion 205, a sheet transport portion 206, an exposure portion 207, an image forming portion 208, a transfer portion 209, a fixing portion 210, a sheet discharge portion 211, a relay portion 212, and a main body control portion 213.

The sheet feeding portion 205 holds a plurality of sheets P, and feeds them out one by one, separately from each other, during printing. The sheet transport portion 206 transports a sheet P fed out from the sheet feeding portion 205 to the transfer portion 209 and the fixing portion 210, and further transports the sheet P having undergone fixing to the sheet discharge portion 211 or to the relay portion 212. The exposure portion 207 emits laser light controlled based on image data toward the image forming portion 208.

The image forming portion 208 includes a photosensitive drum 2081 as an image carrier and a development device 2082. In the image forming portion 208, the laser light emitted from the exposure portion 207 forms, on a surface of the photosensitive drum 2081, an electrostatic latent image based on a document image. The development device 2082 supplies toner to the electrostatic latent image to develop it into a toner image. The transfer portion 209 transfers, onto a sheet P, the toner image formed by the image forming portion 208 on the surface of the photosensitive drum 2081. The fixing portion 210 applies heat and pressure to the sheet P having the toner image transferred thereon to fix the toner image on the sheet P.

After the fixing, the sheet P is transported to the sheet discharge portion 211 or to the relay portion 212. The sheet discharge portion 211 is arranged below the image reading portion 204. The sheet discharge portion 211 has an opening in its front face, and the sheet P after the printing (a printed sheet) is taken out from the front-face side. The relay portion 212 is arranged below the sheet discharge portion 211. The relay portion 212 has its downstream end in a sheet transport direction connected to the sheet post-processing device 5. The sheet P (printed matter) after the printing having been sent to the relay portion 212 passes through the relay portion 212 to be transported into the sheet post-processing device 5.

The main body control portion 213 includes a CPU, an image processing portion, and a storage portion, of which none is illustrated, and other unillustrated electronic circuits and components. The CPU, based on a control program and control data stored in the storage portion, controls operations of various constituent elements provided in the image forming apparatus 200 to perform processing related to functions of the image forming apparatus 200. The sheet feeding portion 205, the sheet transport portion 206, the exposure portion 207, the image forming portion 208, the transfer portion 209, and the fixing portion 210 each individually receive an instruction from the main body control portion 213, and coordinate with each other to perform printing with respect to the sheet P. The storage portion is configured as a combination of non-volatile storage devices such as a program ROM (Read Only Memory) and a data ROM and a volatile storage device such as a RAM (Random Access Memory).

The sheet post-processing device 5 is attachably and detachably connected to a side face of the image forming apparatus 200. The sheet post-processing device 5 includes a post-processing housing 50, and a post-processing mechanism 6, a sheet transport mechanism 7, a processing tray 8, a sheet loading device 10, and a post-processing control portion 100, which are arranged inside the post-processing housing 50.

In such a side face of the post-processing housing 50 as faces the image forming apparatus 200, a sheet receiving port 41 is provided. After passing through the relay portion 212, the sheet P passes through the sheet receiving port 41 to be transported into the sheet post-processing device 5.

A sheet transport path 42 extends from the sheet receiving port 41, in a direction away from the image forming apparatus 200 (leftward in FIG. 1), to a position above the processing tray 8.

The post-processing mechanism 6 performs predetermined post-processing with respect to the sheet P transported along the sheet transport path 42. The post-processing mechanism 6 includes a punching processing portion 61 and a staple processing portion 62.

The punching processing portion 61 is arranged at an intermediate position between the sheet receiving port 41, which is an upstream end of the sheet transport path 42 in the sheet transport direction (an arrow-H11 direction in FIG. 2), and a downstream end of the sheet transport path 42. The punching processing portion 61 performs punching processing with respect to the sheet P transported along the sheet transport path 42 to form a punched hole (a binding hole) in the sheet P. Here, the punched hole is formed along one of opposite edges of the sheet P in its width direction which is perpendicular to the sheet transport direction.

The staple processing portion 62 is arranged at a position that is below the sheet transport path 42 but is on an upstream side of the processing tray 8 in the sheet transport direction. The sheet post-processing device 5, by using the staple processing portion 62, can perform staple processing (binding processing) of binding a bundle of sheets P (hereinafter referred to simply as "sheet bundle") placed on the processing tray 8 with a staple needle to bind the sheet bundle. Here, what is called edge binding processing is performed, in which a sheet bundle is bound with a staple needle at a corner or at an edge.

The sheet transport mechanism 7 transports the sheet P in the sheet transport direction which is along the sheet transport path 42. The sheet transport mechanism 7 has a transport roller pair 71 (see FIG. 2), an intermediate roller pair 72, and a discharge roller pair 73, which are arranged in this order from an upstream side in the sheet transport direction.

The processing tray 8 is arranged below a downstream part of the sheet transport path 42 in a sheet discharge direction. In other words, the processing tray 8 is located at a position that is on a downstream side of the intermediate roller pair 72 in the sheet discharge direction but is below the intermediate roller pair 72. A plurality of sheets P having passed through the sheet transport path 42 to reach the processing tray 8 are placed on the processing tray 8, where the staple processing is performed on them by the staple processing portion 62.

The sheet loading device 10 has a loading tray 11 arranged on a downstream side of the processing tray 8 in the sheet discharge direction to be adjacent to the processing tray 8. The sheets P, with respect to which the staple processing has been completed on the processing tray 8, is discharged by the discharge roller pair 73 to be loaded on the loading tray 11. Here, in a case where the staple processing portion 62 does not perform the staple processing, the sheets P are transported to the loading tray 11 without being loaded on the processing tray 8. A detailed configuration of the sheet loading device 10 will be described later.

The post-processing control portion 100 includes a CPU and a storage portion, of which neither is illustrated, and other unillustrated electronic circuits and components. The post-processing control portion 100 is communicably connected to the main body control portion 213. The post-processing control portion 100 receives an instruction from the main body control portion 213, and, by using the CPU, based on a control program and control data stored in the storage portion, controls operations of various constituent elements provided in the sheet post-processing device 5 to perform processing related to functions of the sheet post-processing device 5. The post-processing mechanism 6, the sheet transport mechanism 7, the processing tray 8, and the sheet loading device 10 each individually receive an instruction from the post-processing control portion 100, and coordinate with each other to perform the post-processing with respect to the sheet P. The storage portion is configured as a combination of storage devices such as a program ROM, a data ROM, a RAM, etc. A detailed control path in the post-processing control portion 100 will be described later.

Figure 2:
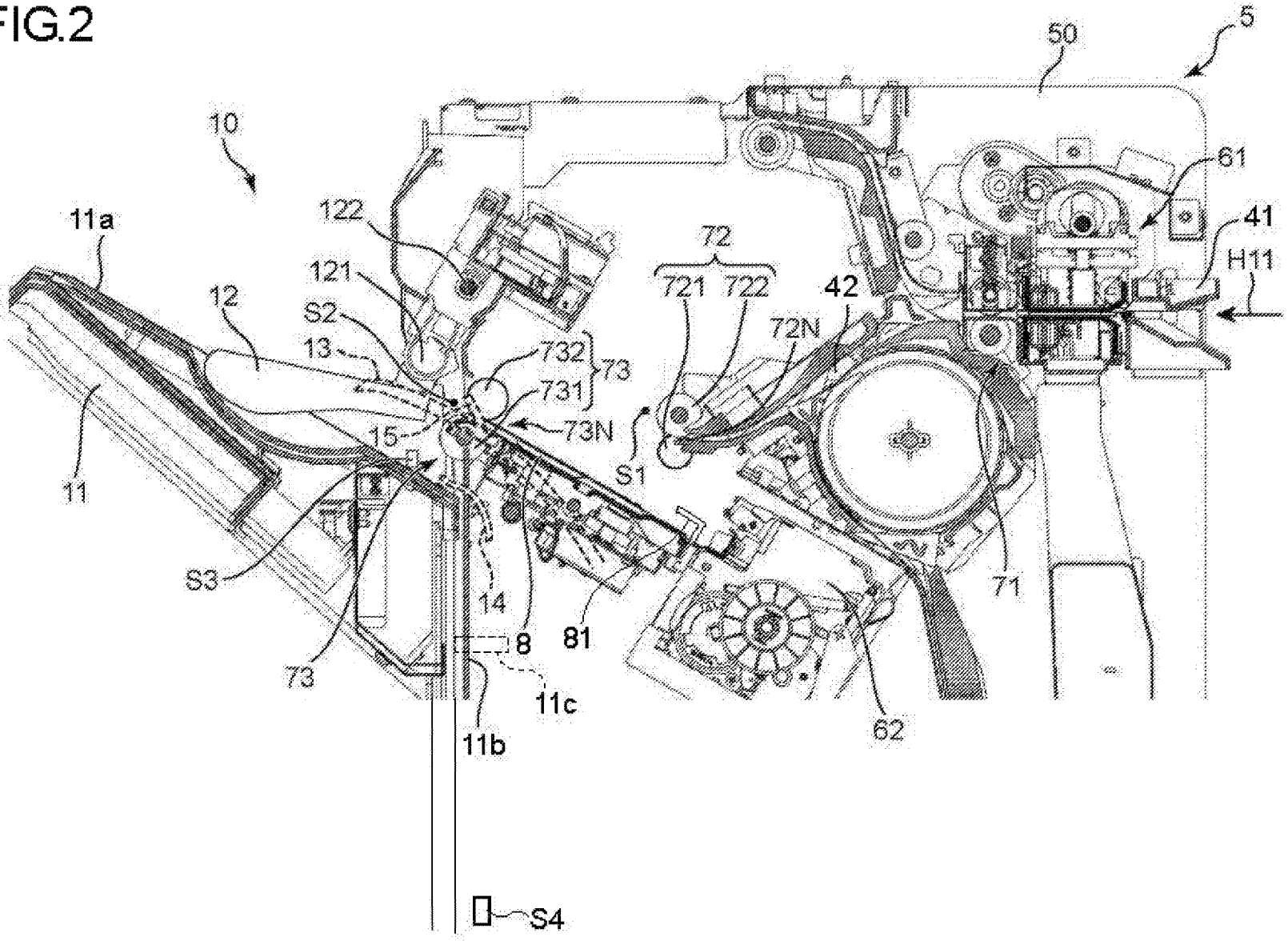
FIG. 2 is a side sectional view showing an internal structure of the sheet post-processing device of the present embodiment.
Figure 3:
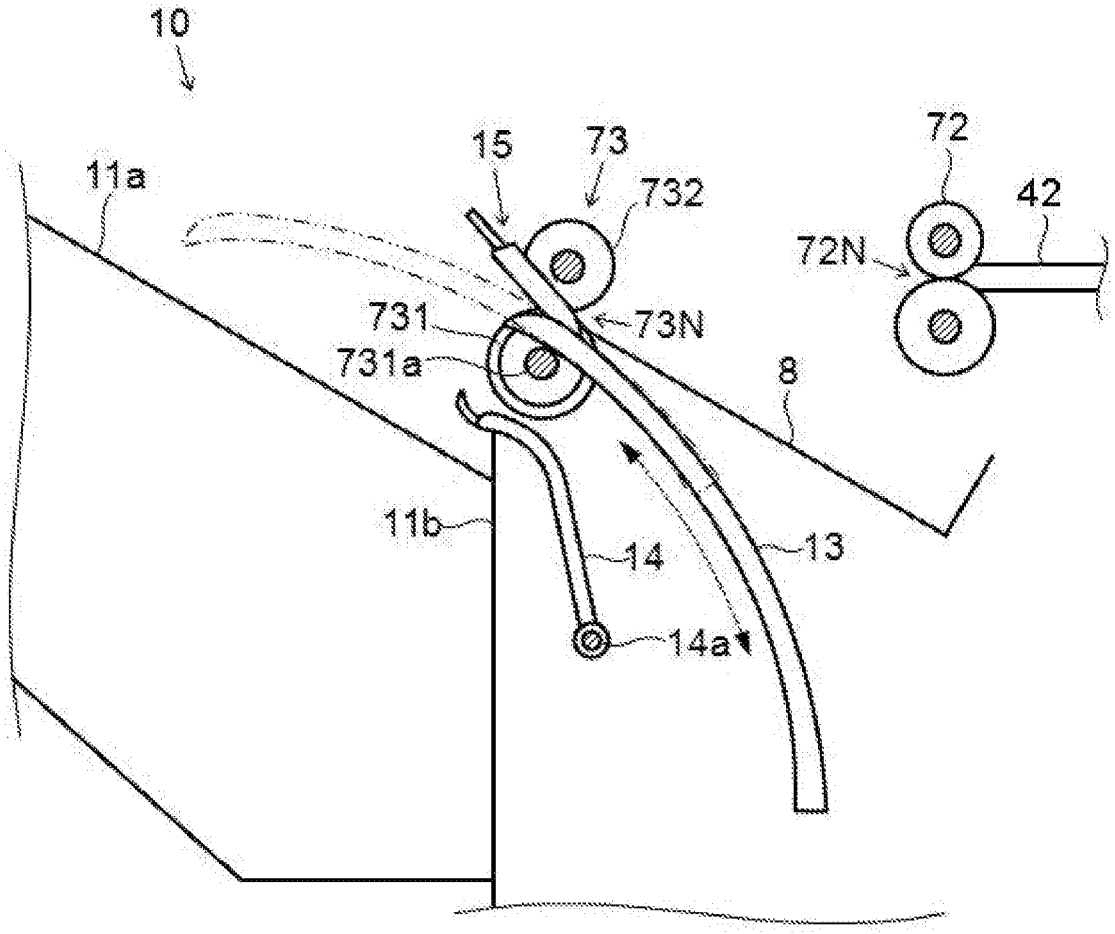
FIG. 3 is an enlarged sectional view of and around a processing tray shown in FIG. 2.

FIG. 2 is a side sectional view showing an internal structure of the sheet post-processing device 5. FIG. 3 is a side sectional view showing a structure of and around the processing tray 8 shown in FIG. 2. The transport roller pair 71 is arranged on a downstream side of the punching processing portion 61 in the sheet transport direction (the arrow-H11 direction) to be adjacent to the punching processing portion 61. The transport roller pair 71 transports a sheet that has undergone the punching processing or a sheet that has not undergone the punching processing to a downstream side in the sheet transport direction H11.

The intermediate roller pair 72 is arranged, on the sheet transport path 42, at a position between an upstream-side end part and a downstream-side end part of the sheet transport path 42 in the sheet transport direction. The intermediate roller pair 72 includes a first drive roller 721 which rotates on receiving a driving force from a transport drive portion 70 (see FIG. 8), and a first driven roller 722 which follows the first drive roller 721 to rotate. The first drive roller 721 and the first driven roller 722 are in contact with each other under a predetermined nip pressure therebetween to form a first nip portion 72N which nips and transports a sheet.

Immediately near the intermediate roller pair 72 on its downstream side, a first sheet detection portion S1 is arranged. The first sheet detection portion S1 is a sensor which optically detects a sheet, and detects that a leading end of a sheet transported by the transport roller pair 71 has entered into the intermediate roller pair 72. The first sheet detection portion S1 also detects that the sheet transported by the intermediate roller pair 72 has passed through the intermediate roller pair 72.

The discharge roller pair 73 is arranged on a downstream side of the sheet transport path 42 in the sheet transport direction. The discharge roller pair 73 includes a second drive roller 731 which rotates on receiving a driving force from a discharge drive portion 90 (see FIG. 8), and a second driven roller 732 which follows the second drive roller 731 to rotate. The second drive roller 731 and the second driven roller 732 are in contact with each other under a predetermined nip pressure therebetween to form a second nip portion 73N which nips and transports a sheet. The second nip portion 73N is released by a nip release mechanism 74 (see FIG. 8) when the staple processing portion 62 performs the staple processing.

Immediately near the discharge roller pair 73 on its downstream side, a second sheet detection portion S2 is arranged. The second sheet detection portion S2 includes an actuator and a photosensor; the actuator has a contact piece, which a sheet discharged by the discharge roller pair 73 comes into contact with, and a detection piece, and the photosensor has a light emitter and a light receiver which are arranged facing each other with the detection piece located therebetween. When the leading end of a sheet transported by the intermediate roller pair 72 comes into contact with the contact piece, the actuator rotationally moves in a clockwise direction, so that the detection piece moves out of an optical path extending from the light emitter to the light receiver. Thereby, it is detected that a leading end of the sheet has entered the discharge roller pair 73 and that the sheet is being discharged by the discharge roller pair 73. On the other hand, when a rear end of the sheet passes by the contact piece, the actuator rotationally moves in a counterclockwise direction, so that the detection piece moves into the optical path extending from the light emitter to the light receiver. Thereby, it is detected that the rear end of the sheet has passed through the discharge roller pair 73.

Below the sheet transport path 42, the processing tray 8 is arranged. The processing tray 8, with the second nip portion 73N of the discharge roller pair 73 released, receives the sheet transported by the intermediate roller pair 72 to have the sheet loaded thereon. A sheet bundle loaded on the processing tray 8 is subjected to the staple processing performed by the staple processing portion 62. The processing tray 8, having its downstream-side end part (left end part in FIG. 2) in the sheet transport direction located near the discharge roller pair 73 and its upstream-side end part (right end part in FIG. 2) located below the intermediate roller pair 72, is inclined downward from its downstream-side end part toward its upstream-side end part in the sheet transport direction.

The processing tray 8 is provided with a bundle discharge member 81 which supports an upstream-side end part (a rear end) of a sheet bundle. The bundle discharge member 81 is fixed to a drive belt (not shown) arranged on a rear-surface side of the processing tray 8, and part of the bundle discharge member 81 projects from a placing surface of the processing tray 8 in an L-shape in side view. Along with the drive belt being rotationally moved by the discharge drive portion 90 (see FIG. 8), the bundle discharge member 81 reciprocates along the placing surface of the processing tray 8 in the sheet transport direction.

A sheet bundle loaded on the processing tray 8 and having been subjected to the staple processing by the staple processing portion 62 is discharged to the sheet loading device 10 by the discharge roller pair 73 with the second nip portion 73N recovered or by the bundle discharge member 81.

The sheet loading device 10 has loaded thereon sheets having been subjected to the post-processing by the post-processing mechanism 6. The sheet loading device 10 includes the loading tray 11, a pair of cursor members 12, a projection member 13, a sheet holding member 14, and a paddle member 15.

The loading tray 11 is arranged on a downstream side of the discharge roller pair 73 with respect to the sheet transport direction (hereinafter may also be referred to as the sheet discharge direction), and is a final destination to which a sheet is discharged in the sheet post-processing device 5. The loading tray 11 has a sheet loading surface 11*a* on which are loaded sheets discharged by the discharge roller pair 73 or by the bundle discharge member 81, such as sheets having been subjected to the punching processing by the punching processing portion 61, a sheet bundle having been subjected to the staple processing by the staple processing portion 62, etc. The sheet loading surface 11*a* is highest at its downstream-end part in the sheet discharge direction, and is inclined downward toward its upstream-side end part.

The upstream-side end part of the sheet loading surface 11*a* is located below the discharge roller pair 73. Immediately near the sheet loading surface 11*a* on its upstream side, a sheet receiving wall 11*b* is provided upright. The sheet receiving wall 11*b* receives the upstream-side end part (the rear end) of a sheet that comes sliding down the sheet loading surface 11*a*.

The loading tray 11 is configured to be able to be lifted and lowered by a tray lifting-lowering drive portion 113 (see FIG. 8) in accordance with an amount of sheets loaded on the sheet loading surface 11*a*. At a position that is slightly downstream of the upstream-side end part of the loading tray 11, a top surface detection sensor S3 is arranged. The top surface detection sensor S3 is a photosensor that detects the sheet loading surface 11*a* or a top surface of a sheet loaded on the sheet loading surface 11*a*. In accordance with a detection signal of the top surface detection sensor S3, an operation of lifting-lowering (positioning) the loading tray 11 performed by the tray lifting-lowering drive portion 113 is controlled. The operation of lifting-lowering the loading tray 11 is performed once for every predetermined number of sheets (for example, every 10 sheets) or at predetermined time intervals (for example, every several seconds). Thereby, a position of a topmost surface of sheets on the sheet loading surface 11*a* is maintained at a constant height.

In a lower part of the post-processing housing 50, a lower limit detection sensor S4 is provided which detects a lower limit position of the loading tray 11. The lower limit detection sensor S4 is a photosensor similar to the top surface detection sensor S3, and can detect, when an optical path of a detection portion is blocked by a flag 11*c* provided on and projecting from the loading tray 11, that the loading tray 11 has descended to the lower limit position. Here, as the top surface detection sensor S3 and the lower limit detection sensor S4, other sensors may be used instead of photosensors. Details of the operation of lifting-lowering the loading tray 11 will be described later.

The pair of cursor members 12 are supported by a holder 121 through which a shaft 122 is inserted. The shaft 122 is supported by the post-processing housing 50 so as to extend along a sheet width direction above the discharge roller pair 73. The holder 121 is supported by the shaft 122 so as to be movable along the sheet width direction. The holder 121 supports the pair of cursor members 12 such that leading end parts of the pair of cursor members 12 are swingable in an up-down direction.

The projection member 13 is a rod-shaped member having a predetermined width in the sheet width direction and extending in the sheet discharge direction in an arc shape, and is arranged below a sheet discharge port 2. In detail, the projection member 13 is arranged below the processing tray 8 so as to be below a discharge path via which a sheet is discharged from the discharge roller pair 73 along the processing tray 8. In the present embodiment, the projection member 13 is arranged, for example, at each of two positions in the sheet width direction, the two positions each being at a predetermined distance from a center part of the loading tray 11 in the sheet width direction. Here, the projection members 13 are arranged at positions different from the position of the paddle member 15 with respect to the sheet width direction.

Figure 4:
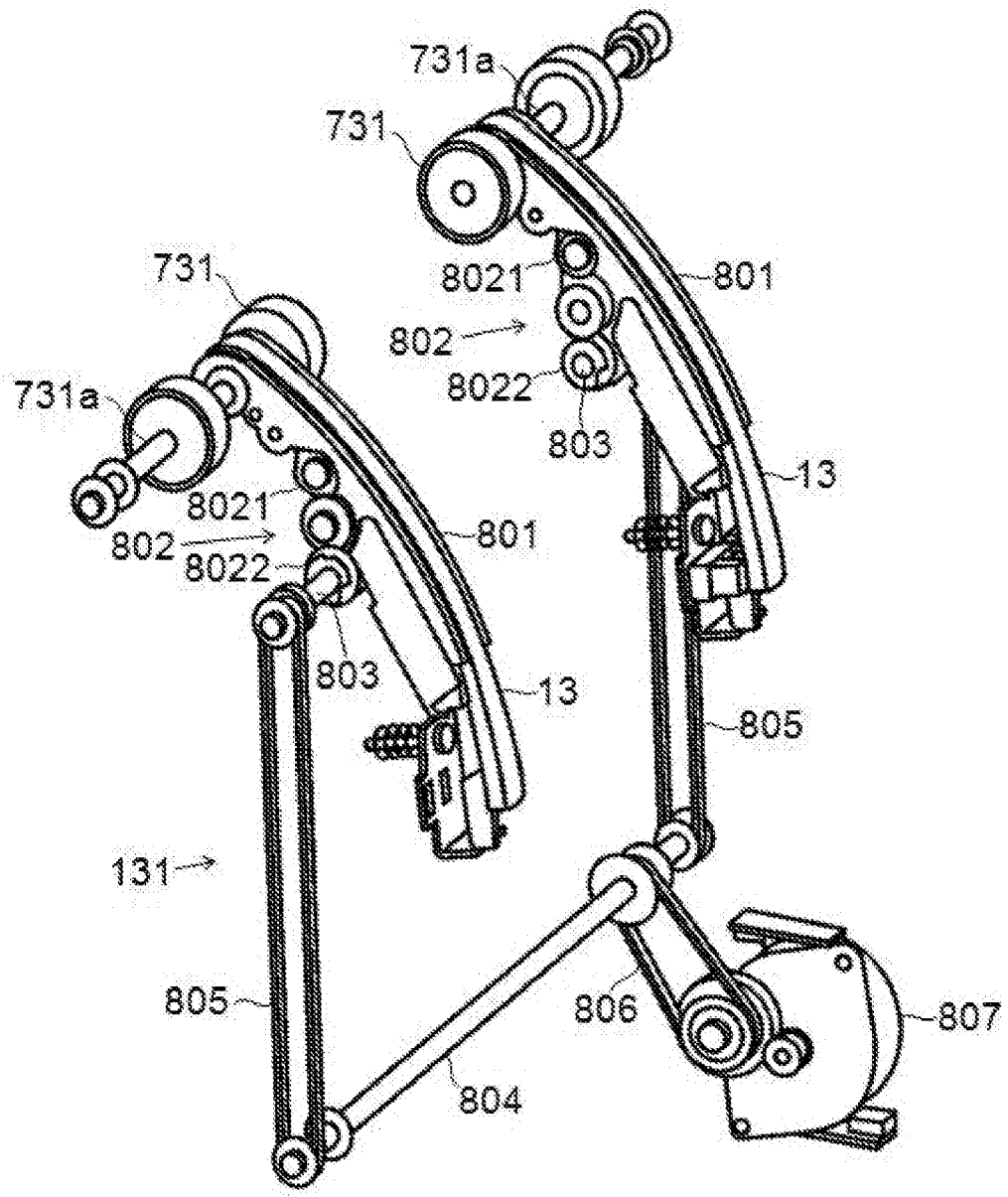
FIG. 4 is a perspective view showing a configuration of a projection drive portion in the sheet post-processing device of the present embodiment, showing a state in which a projection member is at a retraction position.
Figure 5:
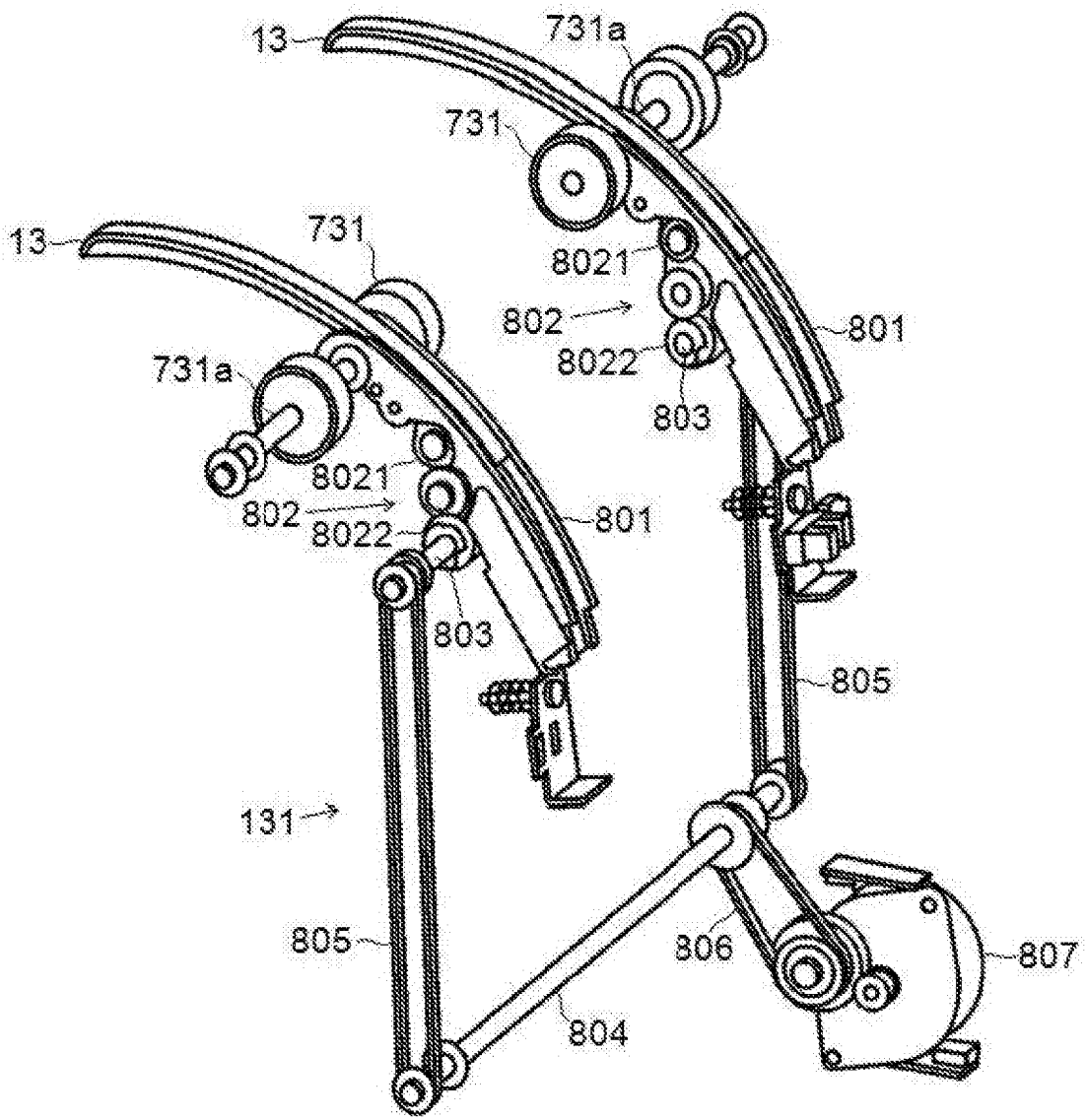
FIG. 5 is a perspective view showing the configuration of the projection drive portion in the sheet post-processing device of the present embodiment, showing a state in which the projection member is at a projection position.

The projection member 13 is supported by a projection drive portion 131 shown in FIGS. 4 and 5, and displaced by the projection drive portion 131 along the sheet discharge direction. The projection drive portion 131 includes a guide rail 801, a drive transmission gear group 802, a drive transmission shaft 803, a drive shaft 804, a drive transmission belt 805, a drive belt 806, and a drive motor 807.

Two guide rails 801, two drive transmission gear groups 802, two drive transmission shafts 803, and two drive transmission belts 805 are provided corresponding to the two projection members 13. One drive shaft 804, one drive belt 806, and one drive motor 807 are provided.

The guide rail 801 is arranged on an upstream side of the discharge roller pair 73 in the sheet discharge direction. The guide rail 801 is an open-topped gutter-shaped member, extending in an arc shape in the sheet discharge direction like the projection member 13. The guide rail 801 accommodates and supports the projection member 13 inside thereof.

The drive transmission gear group 802 is arranged below the guide rail 801. The drive transmission gear group 802 is composed of a plurality of gears in mesh with each other, and includes a pinion gear 8021 at an end on a side of the guide rail 801, and a drive transmission gear 8022 at an end on a side of the drive transmission shaft 803.

The pinion gear 8021 is arranged directly under the guide rail 801. On a lower-face side of the projection member 13, there is formed a rack (not shown) of a rack-and-pinion gear mechanism. The rack has a plurality of teeth aligned along the sheet discharge direction. The pinion gear 8021 meshes with the rack of the projection member 13. Here, in the guide rail 801, at a position adjacent to the pinion gear 8021, there is provided an unillustrated window portion via which the pinion gear 8021 and the projection member 13 mesh with each other.

The drive transmission shaft 803 is arranged in a lower part of the drive transmission gear group 802. The drive transmission shaft 803 extends along the sheet width direction. The drive transmission gear 8022 of the drive transmission gear group 802 is arranged coaxially with the drive transmission shaft 803, and rotates together with the drive transmission shaft 803.

The drive shaft 804 is arranged below the drive transmission shaft 803. The drive shaft 804 extends along the sheet width direction.

The drive transmission belt 805 is wound around the drive transmission shaft 803 and the drive shaft 804 via pulleys. In detail, the two drive transmission belts 805 are wound around the one drive shaft 804, and are respectively wound around the separate drive transmission shafts 803. The drive transmission belts 805 transmit a rotational force of the drive shaft 804 to the drive transmission shafts 803.

The drive belt 806 is wound around the drive shaft 804 and a rotation shaft of the drive motor 807 via pulleys. The drive belt 806 is rotated by the drive motor 807.

In the projection drive portion 131, when the drive motor 807 rotates, a rotational force of the drive motor 807 is transmitted via the drive belt 806 to the drive shaft 804, so that the drive shaft 804 rotates. When the drive shaft 804 rotates, the rotational force is transmitted via the drive transmission belt 805 to the drive transmission shaft 803. When the drive transmission shaft 803 rotates, the rotational force is transmitted via the drive transmission gear group 802 to the pinion gear 8021. Thereby, the two projection members 13 are simultaneously displaced along the sheet discharge direction. The displacement of the projection members 13, in other words, the operation of the projection drive portion 131, is controlled by the post-processing control portion 100.

Referring back to FIG. 3, the sheet holding member 14 is arranged on an upstream side of the loading tray 11 in the sheet discharge direction. The sheet holding member 14 is arranged below a rotation shaft 731*a* of the second drive roller 731 of the discharge roller pair 73. In the present embodiment, as the sheet holding member 14, for example, two sheet holding members 14 are arranged to be spaced from each other by a predetermined distance on the loading tray 11 in the sheet width direction. Here, the sheet holding members 14 are arranged at positions different from the position of the paddle member 15 with respect to the sheet width direction.

The sheet holding member 14 is a rod-shaped member having a predetermined width in the sheet width direction and extending substantially in the up-down direction. The sheet holding member 14 is, at its lower end part, rotatably supported about a swing shaft 14*a*, which extends along the sheet width direction, as a fulcrum. The sheet holding member 14 is caused by a sheet holding drive portion 142 (see FIG. 8) to swing about the swing shaft 14*a* in the sheet discharge direction, with its upper end part as a free end. The sheet holding member 14 is displaced between a holding position (see FIGS. 11 and 12) for holding the upstream part of a sheet P loaded on the loading tray 11 in the sheet discharge direction and a retraction position (see FIG. 3) for releasing the holding of the sheet P.

The sheet holding member 14 is, as shown in FIG. 3, before a sheet discharging operation is started, stationary at the retraction position where it does not project toward the loading tray 11. In this manner, the sheet holding member 14, when out of use, does not interfere with discharging of a sheet P.

Figure 11:
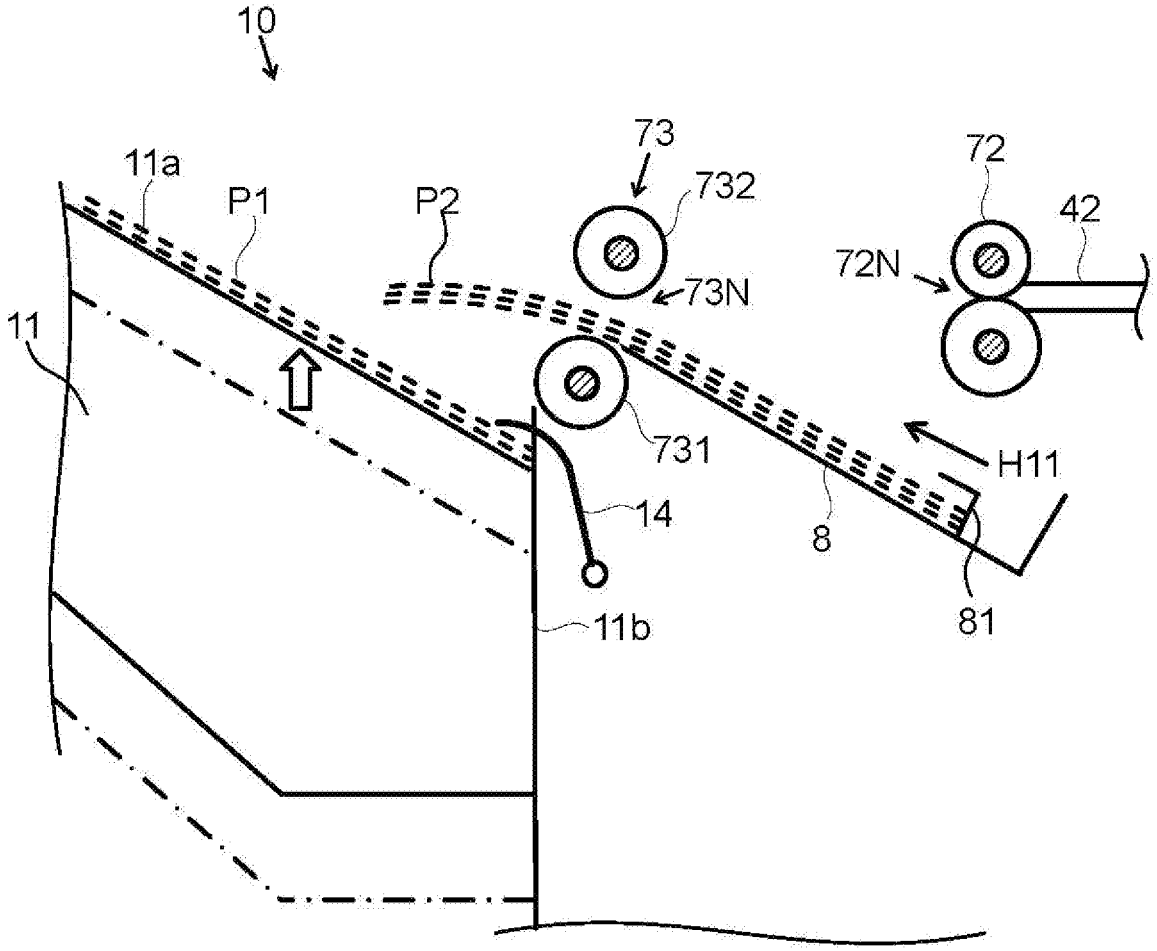
FIG. 11 is a side sectional view of and around the processing tray of the sheet post-processing device, showing a state in which a sheet bundle is being discharged by using a bundle discharge member.
Figure 12:
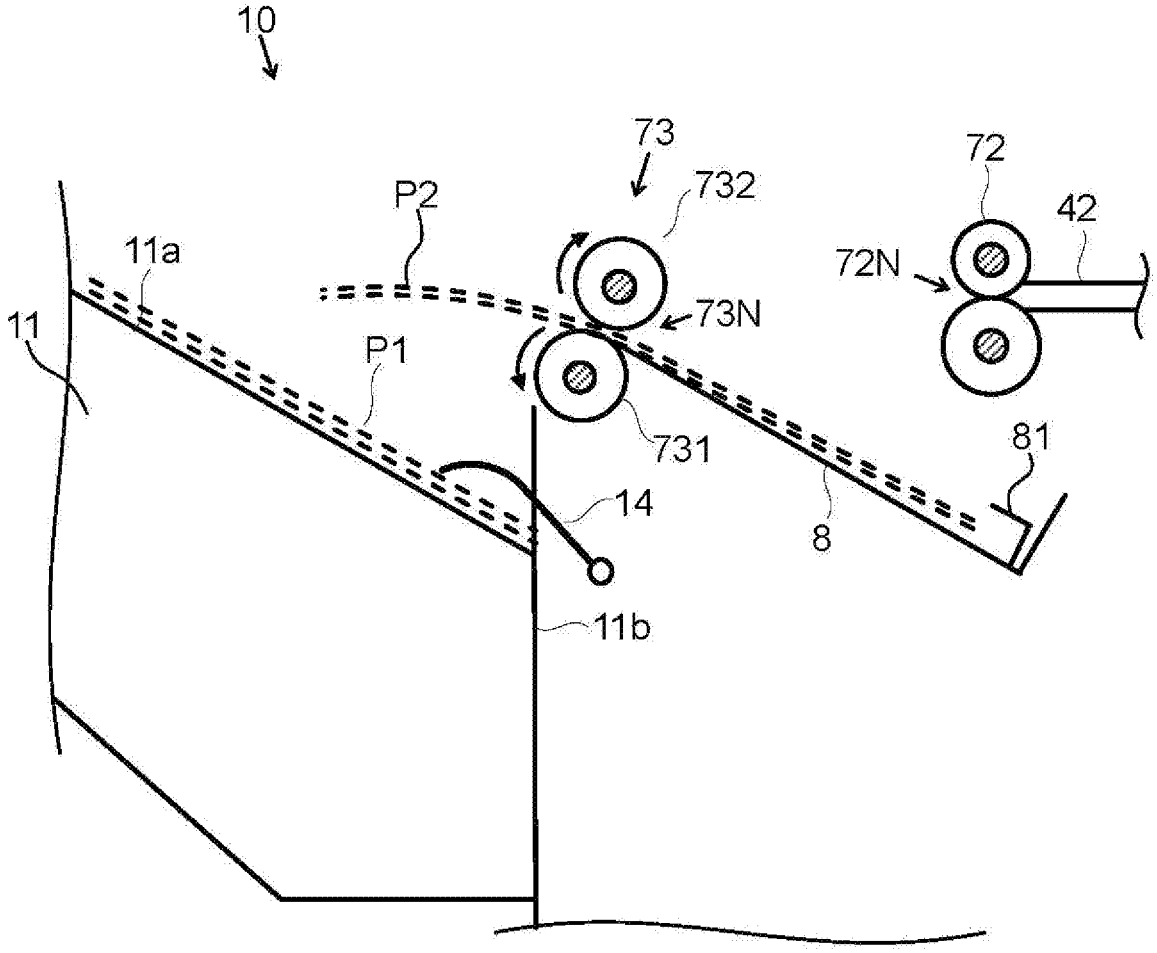
FIG. 12 is a side sectional view of and around the processing tray of the sheet post-processing device, showing a state in which a sheet bundle is being discharged by using a discharge roller pair.

Subsequently, the paddle member 15 is rotated, and, before the paddle member 15 passes an upstream end of the loading tray 11 in the sheet discharge direction, swinging of the sheet holding member 14 is started. Then, the sheet holding member 14 is, as shown in FIGS. 11 and 12, displaced to the holding position where it holds the upstream part of a sheet loaded on the loading tray 11 in the sheet discharge direction.

According to this configuration, it is possible to hold a rear end of a curled sheet from above by means of the sheet holding member 14. Thereby, even a case where the discharging and the loading of sheets with respect to the loading tray 11 are performed at high speed can be handled, so that the upstream part of a sheet loaded on the loading tray 11 in the sheet discharge direction can be held from above, and sheets P on the loading tray 11 can be aligned preferably.

The paddle member 15 is arranged coaxially with the discharge roller pair 73. In detail, the paddle member 15 is arranged coaxially with the rotation shaft 731*a* of the second drive roller 731 extending along the sheet width direction. More in detail, in the present embodiment, two paddle members 15 are provided coaxially with the rotation shaft 731*a* of each of the two second drive rollers 731, such that a total of four paddle members 15 are provided.

Figure 6:
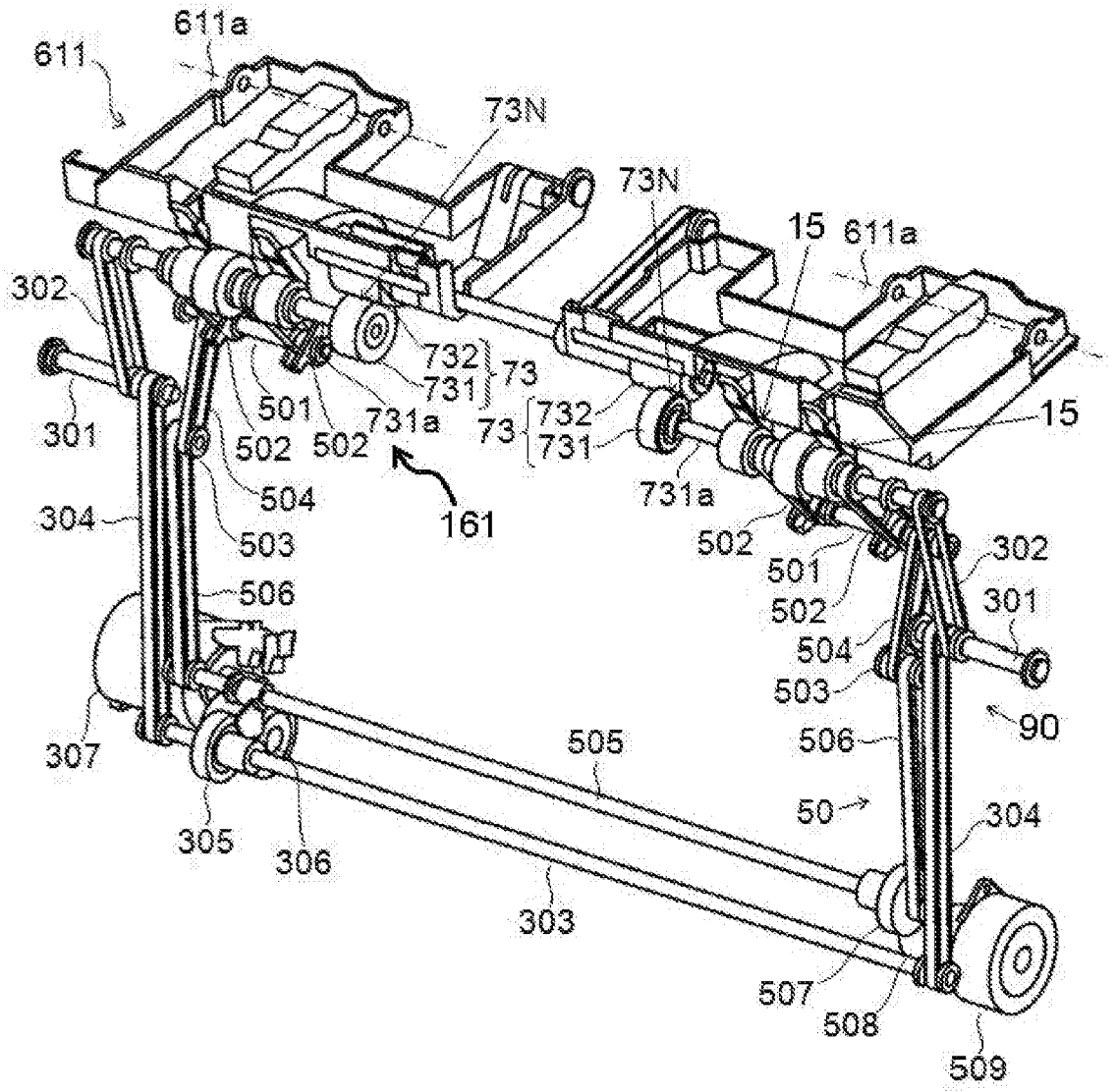
FIG. 6 is a perspective view showing a configuration of a discharge drive portion and a paddle drive portion in the sheet post-processing device of the present embodiment.

FIG. 6 is a perspective view showing a configuration of the discharge drive portion 90 and a paddle drive portion 161 in the sheet loading device 10. The two second drive rollers 731 are simultaneously driven to rotate by the discharge drive portion 90. The discharge drive portion 90, as shown in FIG. 6, includes a drive transmission shaft 301, a first drive transmission belt 302, a drive shaft 303, a second drive transmission belt 304, a drive transmission gear 305, a drive gear 306, and a drive motor 307.

Two drive transmission shafts 301, two first drive transmission belts 302, and two second drive transmission belts 304 are provided corresponding to the two rotation shafts 731*a* of the two second drive rollers 731. One drive shaft 303, one drive transmission gear 305, one drive gear 306, and one drive motor 307 are provided.

The drive transmission shaft 301 is arranged below the rotation shaft 731*a* of the second drive roller 731. The drive transmission shaft 301 extends along the sheet width direction.

The first drive transmission belt 302 is wound around the rotation shaft 731*a* of the second drive roller 731 and the drive transmission shaft 301 via pulleys. The first drive transmission belt 302 transmits a rotational force of the drive transmission shaft 301 to the rotation shaft 731*a*.

The drive shaft 303 is arranged below the drive transmission shaft 301. The drive shaft 303 extends along the sheet width direction.

The second drive transmission belt 304 is wound around the drive transmission shaft 301 and the drive shaft 303 via pulleys. In detail, the two second drive transmission belts 304 are wound around the one drive shaft 303, and are respectively wound around the separate drive transmission shafts 301. The second drive transmission belts 304 transmit a rotational force of the drive shaft 303 to the drive transmission shafts 301.

The drive transmission gear 305 is provided on the drive shaft 303. The drive transmission gear 305 is arranged coaxially with the drive shaft 303, and rotates together with the drive shaft 303.

The drive gear 306 is provided on a rotation shaft of the drive motor 307. The drive gear 306 is rotated by the drive motor 307. The drive gear 306 meshes with the drive transmission gear 305.

In the discharge drive portion 90, when the drive motor 307 rotates, a rotational force of the drive motor 307 is transmitted via the drive gear 306 and the drive transmission gear 305 to the drive shaft 303, so that the drive shaft 303 rotates. When the drive shaft 303 rotates, the rotational force is transmitted via the second drive transmission belt 304 to the drive transmission shaft 301. When the drive transmission shaft 301 rotates, the rotational force is transmitted via the first drive transmission belt 302 to the rotation shaft 731*a* of the second drive roller 731. Thereby, the two second drive rollers 731 are simultaneously driven to rotate. The rotation of the second drive rollers 731, in other words, the operation of the discharge drive portion 90, is controlled by the post-processing control portion 100.

The four paddle members 15 are simultaneously driven to rotate by the paddle drive portion 161. The paddle drive portion 161, as shown in FIG. 6, includes a first drive transmission shaft 501, a first drive transmission belt 502, a second drive transmission shaft 503, a second drive transmission belt 504, a drive shaft 505, a third drive transmission belt 506, a drive transmission gear 507, a drive gear 508, and a drive motor 509.

Four first drive transmission belts 502 are provided corresponding to the four paddle members 15. Two first drive transmission shafts 501, two second drive transmission shafts 503, two second drive transmission belts 504, and two third drive transmission belts 506 are provided corresponding to the two rotation shafts 731*a* of the two second drive rollers 731. One drive shaft 505, one drive transmission gear 507, one drive gear 508, and one drive motor 509 are provided.

Figure 7:
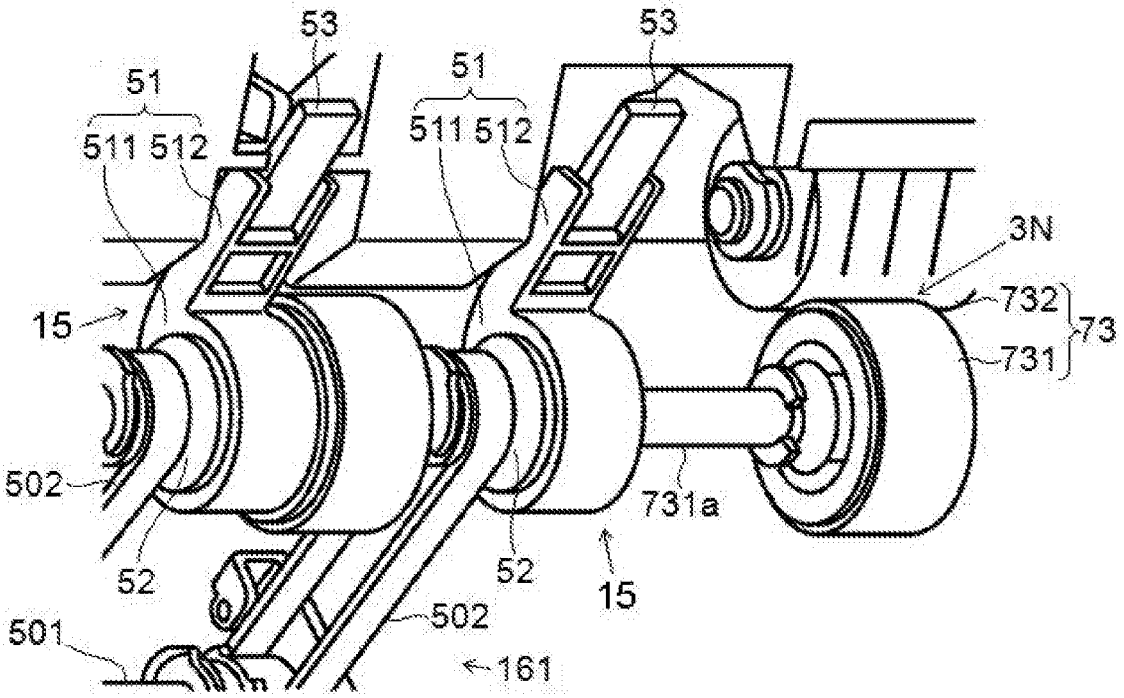
FIG. 7 is a partial perspective view of and around a discharge roller pair in the sheet post-processing device of the present embodiment.

The paddle members 15, as shown in FIG. 7, each include a paddle main body portion 51 and a shaft portion 52. The shaft portion 52 is fixed to a side of the paddle main body portion 51 in the sheet width direction. The paddle main body portion 51 and the shaft portion 52 are configured in cylindrical shapes of which central axes extend in the sheet width direction and arranged coaxially with an axis of the rotation shaft 731*a*. The paddle main body portion 51 has a smaller diameter than the second drive roller 731. The shaft portion 52 has a smaller diameter than the paddle main body portion 51. The rotation shaft 731*a* penetrates, in the sheet width direction, center parts of the paddle main body portion 51 and the shaft portion 52 in a diameter direction. The paddle main body portion 51 and the shaft portion 52 are rotatable independently of the rotation shaft 731*a*.

The first drive transmission shaft 501 is arranged below the rotation shaft 731*a* of the second drive roller 731. The first drive transmission shaft 501 extends along the sheet width direction.

The first drive transmission belt 502 is wound around the shaft portion 52 of the paddle member 15 and the first drive transmission shaft 501 via pulleys. In detail, the two first drive transmission belts 502 are wound around the one first drive transmission shaft 501, and are respectively wound around the shaft portions 52 of the separate paddle members 15. The first drive transmission belts 502 transmit a rotational force of the first drive transmission shaft 501 to the shaft portions 52 of the paddle members 15.

The second drive transmission shaft 503 is arranged below the first drive transmission shaft 501. The second drive transmission shaft 503 extends along the sheet width direction.

The second drive transmission belt 504 is wound around the first drive transmission shaft 501 and the second drive transmission shaft 503 via pulleys. The second drive transmission belt 504 transmits a rotational force of the second drive transmission shaft 503 to the first drive transmission shaft 501.

The drive shaft 505 is arranged below the second drive transmission shaft 503. The drive shaft 505 extends along the sheet width direction.

The third drive transmission belt 506 is wound around the second drive transmission shaft 503 and the drive shaft 505 via pulleys. In detail, the two third drive transmission belts 506 are wound around the one drive shaft 505, and are respectively wound around the separate second drive transmission shafts 503. The third drive transmission belts 506 transmit a rotational force of the drive shaft 505 to the second drive transmission shafts 503.

The drive transmission gear 507 is provided on the drive shaft 505. The drive transmission gear 507 is arranged coaxially with the drive shaft 505, and rotates together with the drive shaft 505.

The drive gear 508 is provided on a rotation shaft of the drive motor 509. The drive gear 508 is rotated by the drive motor 509. The drive gear 508 meshes with the drive transmission gear 507.

In the paddle drive portion 161, when the drive motor 509 rotates, a rotational force of the drive motor 509 is transmitted via the drive gear 508 and the drive transmission gear 507 to the drive shaft 505, so that the drive shaft 505 rotates. When the drive shaft 505 rotates, the rotational force is transmitted via the third drive transmission belt 506 to the second drive transmission shaft 503. When the second drive transmission shaft 503 rotates, the rotational force is transmitted via the second drive transmission belt 504 to the first drive transmission shaft 501. When the first drive transmission shaft 501 rotates, the rotational force is transmitted via the first drive transmission belt 502 to the shaft portion 52 of the paddle member 15. With this arrangement, the four paddle members 15 are driven to rotate simultaneously and are rotatable about an axis of rotation of the second drive roller 731 independently of the second drive roller 731. The rotation of the paddle members 15, in other words, the operation of the paddle drive portion 161, is controlled by the post-processing control portion 100.

The paddle member 15, as shown in FIG. 7, includes the paddle main body portion 51 and a paddle elastic portion 53. The paddle main body portion 51 includes a base portion 511 which has formed therein a shaft hole and through which the rotation shaft 731*a* is inserted, and an arm portion 512 which is provided on an outer peripheral surface of the base portion 511.

The arm portion 512 projects in a direction that crosses an axis of rotation of the base portion 511 and that is away from an axial center. In detail, the arm portion 512 projects from the outer peripheral surface of the base portion 511 outward substantially in a tangent direction of the outer peripheral surface. The arm portion 512 is integrally formed with the base portion 511. The arm portion 512 is made of a material that has a higher modulus of rigidity than a material of the paddle elastic portion 53.

The paddle elastic portion 53 projects longer than the arm portion 512 in a direction that crosses an axis of rotation of the paddle main body portion 51 and that is away from an axial center. In detail, the paddle elastic portion 53 is attached to the arm portion 512, and projects longer than the arm portion 512 in the same direction as the arm portion 512. The paddle elastic portion 53 is configured of a material having a higher elasticity modulus than the arm portion 512 (the paddle main body portion 51), such as a rubber.

Figure 8:
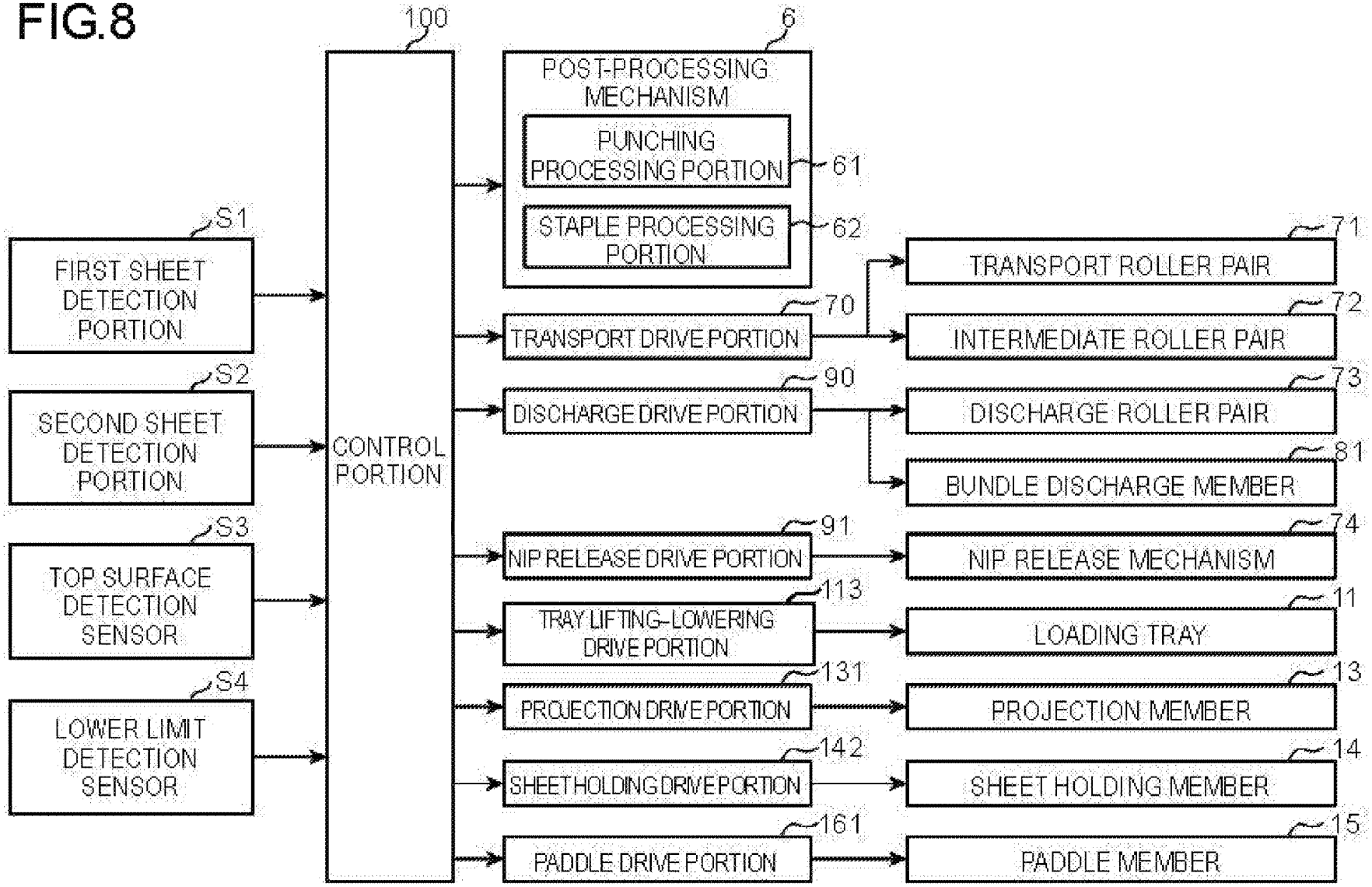
FIG. 8 is a block diagram showing an example of a control path in the sheet post-processing device.

FIG. 8 is a block diagram showing an example of a control path for the sheet post-processing device 5. The post-processing control portion 100 (hereinafter referred to simply as the control portion 100) is constituted by a CPU (Central Processing Unit) which controls operations of various portions of the sheet post-processing device 5 including the sheet loading device 10, a ROM (Read Only Memory) which stores a control program therein, a RAM (Random Access Memory) which is used as an operation area for the CPU, etc. The control portion 100 controls the operations of the various portions of the sheet post-processing device 5 including the sheet loading device 10 by the CPU executing the control program stored in the ROM.

The control portion 100 controls a punching processing operation performed by the punching processing portion 61 of the post-processing mechanism 6 and a staple processing operation performed by the staple processing portion 62 of the post-processing mechanism 6. The control portion 100 controls driving of the transport drive portion 70, and thereby controls rotating and stopping of the transport roller pair 71 and the intermediate roller pair 72. The control portion 100 controls driving of the discharge drive portion 90, and thereby controls rotating and stopping of the discharge roller pair 73 or reciprocating movement of the bundle discharge member 81.

The control portion 100 controls driving of a nip release drive portion 91, and thereby controls operations of releasing and recovering the second nip portion 73N of the discharge roller pair 73 performed by the nip release mechanism 74. For example, in a case where the staple processing is performed by the staple processing portion 62 with respect to a sheet bundle of a predetermined number of sheets, the control portion 100, after a first sheet is pulled into the processing tray 8, makes the nip release drive portion 91 drive the nip release mechanism 74 to release the second nip portion 73N. Then, after a second and subsequent sheets are pulled into the processing tray 8 and the staple processing is performed, the second nip portion 73N is recovered to discharge the sheet bundle onto the loading tray 11.

Here, in a case of discharging a sheet bundle onto the loading tray 11 by means of the bundle discharge member 81, with the second nip portion 73N released, the bundle discharge member 81 is moved to the downstream side in the sheet discharge direction, and the sheet bundle is pushed out and discharged onto the loading tray 11.

The control portion 100 controls driving of the tray lifting-lowering drive portion 113, and thereby controls the operation of lifting-lowering the loading tray 11. The control portion 100 controls driving of the projection drive portion 131, and thereby controls movement of the projection member 13 between a projection position and a retraction position along the guide rail 801. The control portion 100 controls driving of the sheet holding drive portion 142, and thereby controls a swinging operation which the sheet holding member 14 performs, by rotating about the swing shaft 14*a*, to swing between the holding position and the retraction position.

The control portion 100 controls driving of the paddle drive portion 161, and thereby controls a slapping operation which the paddle member 15 performs, by rotating about the rotation shaft 731*a*, to slap, toward the loading tray 11, a rear end of a sheet having passed through the discharge roller pair 73, and a holding operation which the paddle member 15 performs subsequently to the slapping operation to come into contact, from above, with the rear end part of the sheet having fallen into the loading tray 11 to hold the sheet down while pulling the sheet toward the upstream side.

As described above, in a case where the discharge roller pair 73 is used to discharge a sheet bundle onto the loading tray 11, since the sheet bundle becomes heavier with the number of sheets included therein, the drive motor 307 needs to be a motor with large drive torque, which is expensive.

Further, as a sheet bundle includes more sheets (has a heavier weight), it is more likely that a rear end of the sheet bundle will be curled and that a sheet already loaded on the loading tray 11 will be pushed out.

On the other hand, in a case where the bundle discharge member 81 is used to discharge a sheet bundle onto the loading tray 11, although even a case where the sheet bundle includes a large number of sheets (has a heavy weight) can be handled, the sheet bundle is discharged at a lower discharge speed as compared with the case where the discharge roller pair 73 is used, and thus processing efficiency (productivity) is degraded.

Figure 9A:
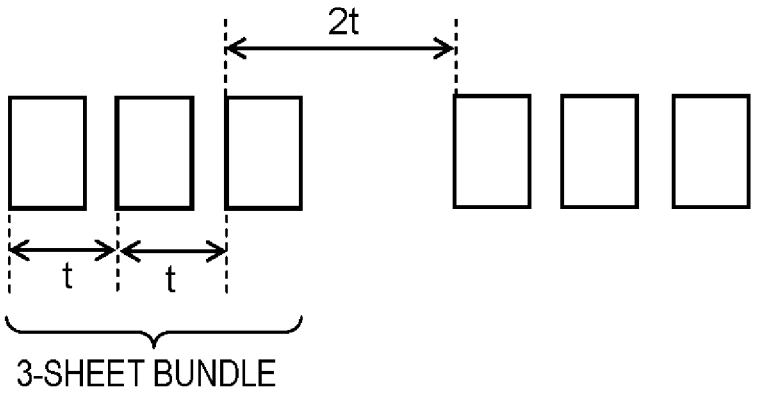
FIG. 9A is a diagram for illustrating a relationship between the number of sheets in a sheet bundle and processing efficiency (productivity), showing a case where the sheet bundle includes a small number of sheets.

FIG. 9 shows diagrams for illustrating a relationship between the number of sheets included in a sheet bundle and the processing efficiency (productivity). FIG. 9A shows a case where sheet bundles each include a small number (here, three) of sheets, and when an interval between sheets is represented by "t" and an interval between sheet bundles is represented by "2t", the processing efficiency (productivity) is as follows: substantial processing time (3t)/per-bundle processing time (4t)×100=75%.

Figure 9B:
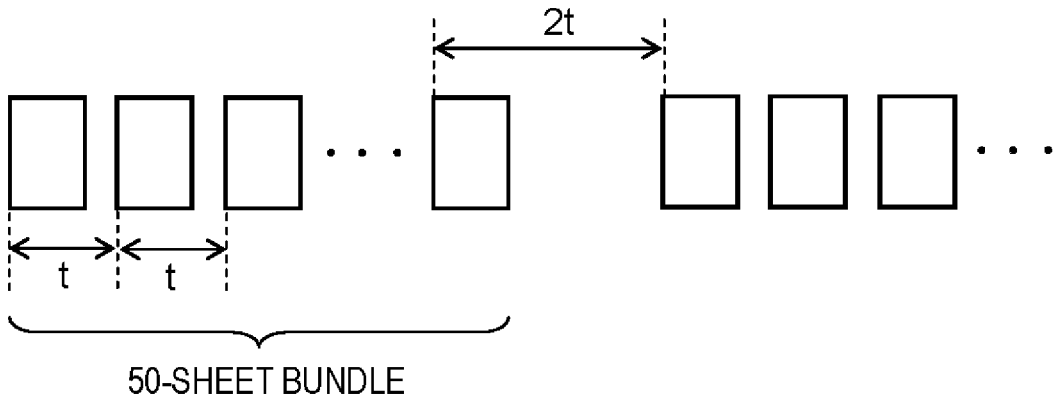
FIG. 9B is a diagram for illustrating the relationship between the number of sheets in a sheet bundle and processing efficiency (productivity), showing a case where the sheet bundle includes a large number of sheets.

FIG. 9B shows a case where sheet bundles each include a large number of sheets (here, bundles of 50 sheets), and the processing efficiency (productivity) is as follows: substantial processing time (50t)/per-bundle processing time (51t)×100≈98%. That is, since the productivity is lower as a sheet bundle includes a smaller number of sheets, it is important to enhance the productivity by shortening the interval between sheets.

Thus, in the present embodiment, to discharge a sheet bundle from the processing tray 8 onto the loading tray 11, a selection is made between discharging via the discharge roller pair 73 and discharging via the bundle discharge member 81, depending on the number of sheets in the sheet bundle. Specifically, when a small number of sheets are in a sheet bundle, discharging via the discharge roller pair 73 is selected, while discharging via the bundle discharge member 81 is selected when a large number of sheets are in a sheet bundle. Further, when discharging via the bundle discharge member 81 is selected, the sheet bundle is discharged with the loading tray 11 having been lifted above the reference position.

Figure 10:
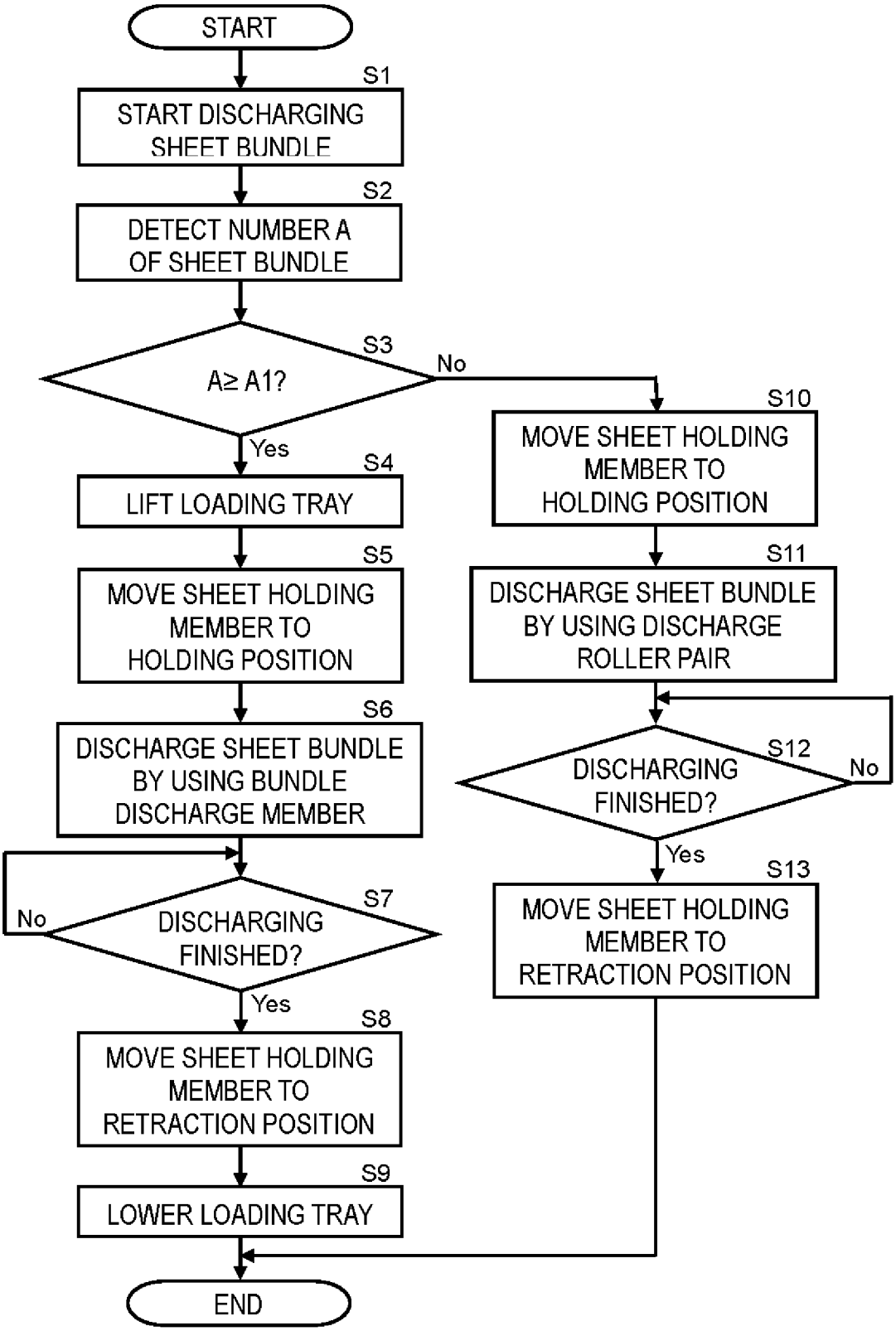
FIG. 10 is a flowchart showing an example of control in a sheet bundle discharging operation of discharging a sheet bundle from the processing tray into a loading tray in the sheet post-processing device of the present embodiment.

FIG. 10 is a flowchart showing an example of control in a sheet bundle discharging operation of discharging a sheet bundle from the processing tray 8 onto the loading tray 11 in the sheet post-processing device 5 of the present embodiment. With reference to FIGS. 1 to 8 and later-described FIGS. 11 and 12, as necessary, along the steps shown in FIG. 10, a description will be given of the sheet bundle discharging operation of discharging a sheet bundle from the processing tray 8 onto the loading tray 11.

First, the sheet post-processing device 5 is set in a mode (bundle processing mode) in which the staple processing is performed with respect to a sheet bundle loaded on the processing tray 8, and the loading tray 11 of the sheet loading device 10 is arranged at the reference position.

When, from this state, discharging of a sheet bundle onto the loading tray 11 is started (step S1), the control portion 100 detects a number A of sheets in the sheet bundle (step S2). The number A of sheets in the sheet bundle can be detected by, for example, counting the number of sheets that pass the first sheet detection portion S1 (or the second sheet detection portion S2).

Next, the control portion 100 determines whether or not the number A of sheets included in the discharged sheet bundle is equal to or larger than a predetermined number A1 (for example, 50) (Step S3). When A≥A1, (Yes in step S3), the loading tray 11 is lifted from the reference position (step S4), and the sheet holding member 14 is moved to the holding position (step S5). Then, by using the bundle discharge member 81, the sheet bundle is discharged from the processing tray 8 onto the loading tray 11 (step S6).

FIG. 11 is a side sectional view of and around the processing tray 8 of the sheet post-processing device 5, showing a state in which a sheet bundle P2 is being discharged by using the bundle discharge member 81. As shown in FIG. 11, the second nip portion 73N of the discharge roller pair 73 is released by the nip release drive portion 91, and the discharge drive portion 90 moves the bundle discharge member 81 from upstream side to downstream side (from right to left in FIG. 11) of the processing tray 8, whereby the sheet bundle P2 on the processing tray 8 is discharged onto the loading tray 11.

The loading tray 11 has moved upward from the reference position (indicated by a dash-dotted line in FIG. 11), and thus height difference between the loading tray 11 and the processing tray 8 has been reduced. As a result, a leading end of the sheet bundle P2 discharged from the processing tray 8 quickly comes into contact with a sheet bundle P1 loaded on the loading tray 11, and thus, a downward curl of the leading end of the sheet bundle P2 can be suppressed. Further, the sheet holding member 14 arranged at the holding position holds a rear end of the sheet bundle P1, and this helps suppress pushing out of the sheet bundle P1 by the sheet bundle P2.

Next, the control portion 10 determines whether or not the discharging of a sheet bundle has been finished (step S7). In a case where the discharging of the sheet bundle has been finished (Yes in step S7), the sheet holding member 14 is moved to the retraction position (step S8). Thereafter, the loading tray 11 is lowered to the reference position (step S9), and the process is finished.

On the other hand, when A<A1 in step S3 (No in step S3), the sheet holding member 14 is moved from the retraction position to the holding position (step S10). Then, by using the discharge roller pair 73, a sheet bundle is discharged from the processing tray 8 onto the loading tray 11 (Step S11).

FIG. 12 is a side sectional view of and around the processing tray 8 of the sheet post-processing device 5, showing a state in which the sheet bundle P2 is being discharged by using the discharge roller pair 73. As shown in FIG. 12, with the second nip portion 73N of the discharge roller pair 73 being under pressure, the discharge drive portion 90 rotates the discharge roller pair 73, and thereby, the sheet bundle P2 on the processing tray 8 is discharged onto the loading tray 11.

Since the number of the sheets in the sheet bundle P2 discharged by the discharge roller pair 73 is small, no downward curl of the leading end of the sheet bundle P2 is likely to occur. Thus, the loading tray 11 is arranged at the reference position. Further, the sheet holding member 14 arranged at the holding position holds the rear end of the sheet bundle P1 loaded on the loading tray 11, and thus the pushing out of the sheet bundle P1 by the sheet bundle P2 is also suppressed.

Next, the control portion 100 confirms whether or not discharging of a sheet bundle has been finished (step S12). In a case where the discharging of the sheet bundle has been finished (Yes in step S12), the sheet holding member is moved to the retraction position (step S13), and the process is finished.

According to the above-mentioned example of control, when the number A of sheets in a sheet bundle is equal to or larger than the predetermined number A1 (=50), the bundle discharge member 81 is used to discharge the sheet bundle. Thus, in a case where a sheet bundle includes a large number of sheets and thus is heavy, the sheet bundle can be discharged smoothly by using the bundle discharge member 81. Further, by discharging a sheet bundle with the loading tray 11 having been lifted from the reference position, it is possible to suppress a downward curl of the leading end of a sheet bundle, which is likely to occur particularly when the sheet bundle includes a large number of sheets.

On the other hand, in a case where the number A of sheets included in a sheet bundle is smaller than the predetermined number A1, the discharge roller pair 73 is used to discharge the sheet bundle. Thus, in a case where a sheet bundle includes a small number of sheets, a sheet bundle discharging operation emphasizing the processing efficiency (productivity) can be performed by using the discharge roller pair 73. Further, as the drive motor 307 which drives the discharge roller pair 73, a small inexpensive motor with small driving torque can be used, and this contributes to cost reduction of the sheet post-processing device 5. Further, since the sheet bundle includes a small number of sheets and no downward curl of the leading end of the sheet bundle is likely to occur, the sheet bundle can be discharged with the loading tray 11 arranged at the reference position. This eliminates the need of the operation of lifting and lowering the loading tray 11, and thus helps further improve the processing efficiency (productivity).

In the example of control shown in FIG. 10, only in the case where a sheet bundle is discharged by using the bundle discharge member 81, the sheet bundle is discharged with the loading tray 11 having been lifted above the reference position. However, even in the case where a sheet bundle is discharged by using the discharge roller pair 73, when the sheet bundle includes a large number of sheets (for example, when equal to or larger than a predetermined number A2 (A2<A1)), the sheet bundle may be discharged with the loading tray 11 having been lifted above the reference position.

Further, by performing the discharging of a sheet bundle with the sheet holding member 14 having been moved to the holding position and then moving the sheet holding member 14 to the retraction position after the discharging of the sheet bundle, it is possible to prevent a problem where the sheet bundle having been discharged onto the loading tray 11 is pushed out by a following sheet bundle to disturb the alignment on the loading tray 11 or to fall out of the loading tray 11.

Here, as the sheet holding member 14 is moved from the holding position to the retraction position at a later timing, the loading tray 11 is also moved at a later timing to the reference position for discharge using the bundle discharge member 81. Thus, in view of suppressing the moving out of a sheet bundle, it is more preferable to move the sheet holding member 14 at a timing as late as possible. On the other hand, in a case where emphasis is on the processing efficiency (productivity), it is more preferable to make the timing of moving the sheet holding member 14 to the retraction position earlier, and start the moving of the loading tray 11 to the reference position earlier.

Thus, in a case where the bundle discharge member 81 is used to discharge a sheet bundle, it is preferable to make the timing of moving the sheet holding member 14 to the retraction position later than in the case where the discharge roller pair 73 is used to discharge a sheet bundle. According to this configuration, when sheet bundles including a large number of sheets are discharged by using the bundle discharge member 81, the sheet holding member 14 can hold a sheet bundle on the loading tray 11 for a long time, and thus it is possible to effectively suppress the pushing out of the sheet bundle. On the other hand, when sheet bundles including a small number of sheets are discharged by using the discharge roller pair 73, the sheet holding member 14 is retracted earlier, and thereby the moving of the loading tray 11 to the reference position can be started earlier, which helps enhance the processing efficiency (productivity).

Here, even in the case where the discharge roller pair 73 is used to discharge a sheet bundle, when the sheet bundle includes a large number of sheets (for example, equal to or larger than the predetermined number A2 (A2<A1)), the timing of moving the sheet holding member 14 to the retraction position may be made later than in the case where the sheet bundle includes a small number (smaller than A2) of sheets.

The present disclosure is not limited to the embodiments described above and various modifications thereto can be made without departing from the spirit and scope of the present disclosure. For example, in the embodiments described above, the projection member 13 is displaced between the projection position at which a sheet discharged by the discharge roller pair 73 comes into contact with the top surface of the projection member 13 and the retraction position at which the projection member 13 is retracted to the upstream side in the sheet discharge direction, but a configuration is possible without the projection member 13.

Further, in the embodiments described above, the image forming apparatus 200 in the image forming system S is a multifunction peripheral for monochrome printing, but this is not meant to limit the present disclosure. The image forming apparatus 200 may instead be, for example, a monochrome copier, a monochrome printer, or the like, or may instead be an image forming apparatus for color printing, such as a color copier, a color printer, or the like.

What is claimed is:

1. A sheet post-processing device comprising:

a processing tray which receives a predetermined number of sheets to have the sheets loaded thereon;

a post-processing mechanism which performs predetermined post-processing with respect to a sheet bundle loaded on the processing tray;

a discharge roller pair which includes a drive roller and a driven roller which follows the drive roller to rotate, and which discharges the sheet bundle loaded on the processing tray;

a bundle discharge member which is reciprocatable along a loading surface of the processing tray, and which discharges the sheet bundle loaded on the processing tray by pushing out the sheet bundle;

a loading tray which is arranged on a downstream side of the processing tray with respect to a discharge direction of the sheet bundle, and on which the sheet bundle having been discharged by the discharge roller pair or by the bundle discharge member is loaded;

a sheet holding member which is arranged below the discharge roller pair, and which is swingable between a holding position at which the sheet holding member holds an upstream part, in the discharge direction, of the sheet bundle loaded on the loading tray and a retraction position at which the sheet holding member releases holding of the sheet bundle;

a tray lifting-lowering drive portion which lifts and lowers the loading tray;

a discharge drive portion which drives the discharge roller pair and the bundle discharge member;

a sheet holding drive portion which swings the sheet holding member to the holding position and to the retraction position; and a control portion which controls the tray lifting-lowering portion, the discharge drive portion, and the sheet holding drive portion, wherein in a case where a number A of sheets included in the sheet bundle loaded on the processing tray is smaller than a predetermined number A1, the control portion discharges the sheet bundle onto the loading tray by using the discharge roller pair, with the loading tray arranged at a reference position, and in a case where the number A of the sheets included in the sheet bundle is equal to or larger than the predetermined number A1, the control portion discharges the sheet bundle onto the loading tray by using the bundle discharge member, with the loading tray having been lifted above the reference position.

2. The sheet post-processing device according to claim 1, wherein, in a case where the control portion discharges the sheet bundle onto the loading tray by using the discharge roller pair, when the number A of the sheets included in the sheet bundle is equal to or larger than a predetermined number A2 (A2<A1), the control portion discharges the sheet bundle onto the loading tray with the loading tray having been lifted above the reference position.

3. The sheet post-processing device according to claim 1, wherein the control portion discharges the sheet bundle onto the loading tray with the sheet holding member arranged at the holding position, and in a case where the loading tray has been lifted above the reference position, the control portion lowers the loading tray to the reference position after moving the sheet holding member to the retraction position.

4. The sheet post-processing device according to claim 3, wherein in a case where the control portion discharges the sheet bundle onto the loading tray by using the bundle discharge member, the control portion makes a timing of moving the sheet holding member to the retraction position later than in the case where the control portion discharges the sheet bundle onto the loading tray by using the discharge roller pair.

5. The sheet post-processing device according to claim 3, wherein in the case where the control portion discharges the sheet bundle onto the loading tray by using the discharge roller pair, when the number A of the sheets included in the sheet bundle is equal to or larger than a predetermined number A2 (A2<A1), the control portion makes the timing of moving the sheet holding member to the retraction position later than when the number A of the sheets included in the sheet bundle is smaller than A2.

6. An image forming system comprising:

the sheet post-processing device according to claim 1; and an image forming apparatus which is connected to the sheet post-processing device, forms an image on the sheet, and transports the sheet having the image formed thereon into the sheet post-processing device.

* * * * *